US005633127A

United States Patent [19]

Nair et al.

[11] Patent Number: 5,633,127

[45] Date of Patent: May 27, 1997

[54] IMAGING ELEMENTS CAPABLE OF PROVIDING IN A SINGLE LAYER AN IMAGE AND AN INDEPENDENT MAGNETIC RECORD

[75] Inventors: Mridula Nair, Penfield; George L. Oltean, Rochester, both of N.Y.

[73] Assignee: Eastman Kodak Company, Rochester, N.Y.

[21] Appl. No.: 626,228

[22] Filed: Mar. 29, 1996

[51] Int. Cl.$^6$ ..... G03C 1/76

[52] U.S. Cl. ..... 430/496; 430/140; 430/501; 428/694 BS; 428/694 B; 428/694 BG; 428/900

[58] Field of Search ..... 430/140, 496, 430/523, 501, 495.1; 428/694 BS, 694 B, 694 BG, 900

[56] References Cited

U.S. PATENT DOCUMENTS

| | | | |
|---|---|---|---|
| 3,782,947 | 1/1974 | Krall | 430/30 |
| 4,279,945 | 7/1981 | Audran et al. | 427/130 |
| 4,758,275 | 7/1988 | Yubakami et al. | 106/20 |
| 4,990,276 | 2/1991 | Bishop et al. | 252/62.54 |
| 5,457,012 | 10/1995 | Nair et al. | 430/495 |
| 5,520,954 | 5/1996 | Oltean et al. | 427/128 |
| 5,531,913 | 7/1996 | Nair et al. | 430/140 |
| 5,558,977 | 9/1996 | DePalma et al. | 430/496 |

FOREIGN PATENT DOCUMENTS 686172 5/1964 Canada .

OTHER PUBLICATIONS

Research Disclosure, vol. 365, Sep. 1994, Item 36544.

Research Disclosure, vol. 184, Aug. 1979, Item 18431.

Keller Science and Technology of Photography, VCH Publishers, New York, 1993, p. 58.

*Primary Examiner*—Mark F. Huff

*Attorney, Agent, or Firm*—Carl O. Thomas

[57] ABSTRACT

An imaging element is disclosed comprised of a support and, coated on the support, at least one radiation-sensitive emulsion layer containing (a) radiation-sensitive silver halide grains and (b) an aqueous processing solution permeable vehicle, wherein the radiation-sensitive emulsion layer additionally contains (c) from 0.1 to 10 mg/dm$^2$ of magnetic particles having a major axis less than 1 μm and, (d) based on the weight of the magnetic particles, from 10 to 200 percent of an amphipathic dispersant for the magnetic particles having a hydrophilic/lipophilic balance number of at least 8.

17 Claims, No Drawings

IMAGING ELEMENTS CAPABLE OF PROVIDING IN A SINGLE LAYER AN IMAGE AND AN INDEPENDENT MAGNETIC RECORD

FIELD OF THE INVENTION

The invention relates to radiation-sensitive imaging elements capable of forming an image and a magnetic record.

BACKGROUND

Imaging elements that contain coated on a support one or more radiation-sensitive silver halide emulsion layers to record imagewise exposure have been widely employed in both photography and radiography, since the imaging speeds usually far exceed those obtainable with other available radiation-sensitive materials. The emulsion layers contain radiation-sensitive silver halide grains, which are responsible for capturing electromagnetic radiation to form a latent image, and an aqueous processing solution permeable vehicle, which includes a peptizer for the silver halide grains and a binder to impart structural integrity to the layer or layers and adhesion to the support. Typically both the peptizer and the vehicle are comprised of a hydrophilic colloid, such as gelatin or a gelatin derivative. The radiation-sensitive silver halide emulsion layers as well as any other layers that, after imagewise exposure of the element, must be penetrated by aqueous processing solutions to produce a viewable image are typically coated as an aqueous dispersion on the imaging element support and then dried and hardened. Hardening allows the layers to retain their structural integrity when subsequently brought into contact with aqueous processing solutions, typically at elevated temperatures, but hardening is limited so that the layers remain processing solution permeable. The ability to construct radiation-sensitive silver halide emulsion layers and other, associated processing solution permeable layers using aqueous coating compositions is an important advantage in the manufacture of the imaging elements.

A general summary of photographic and radiographic imaging elements containing one or more silver halide emulsion layers, hereinafter referred to as silver halide imaging elements, is provided by *Research Diclosure*, Vol. 365, September 1994, Item 36544, and *Research Diclosure*, Vol. 184, August 1979, Item 18431. *Research Disclosure* is published by Kenneth Mason Publications, Ltd., Dudley House, 12 North St., Emsworth, Hampshire P010 7DQ, England.

It has been long recognized that magnetic recording layers can be usefully added to silver halide imaging elements to provide additional information. For example, a magnetic layer can be employed to record information relating to exposure and/or processing. Many, varied purposes can be served, depending upon the specific imaging application. For example, in motion picture film the magnetic recording layer can be used to provide a sound track, whereas in radiography the magnetic recording layer can be used to provide a permanent correlation between the image recorded and patient specific information. Specific citations of magnetic recording layers combined with silver halide photographic elements is provided by *Research Disclosure* Item 36544, cited above, XIV. Scan facilitating features, subparagraph (2).

Because of a variety of incompatibilities the clearly preferred location for a magnetic recording layer in a silver halide imaging element has been on the side of the support opposite that bearing the silver halide emulsion layer or layers—i.e., on the back side of support. Among the significant draw backs to integrating magnetic recording layers in silver halide imaging elements have been the following:

(1) The fact that magnetic recording layers have been typically coated using non-aqueous solvents. This has provided a disadvantage in manufacture, requiring separation of the magnetic recording layer and silver halide emulsion layer coating steps. Additionally, in many instances the resulting non-aqueous coatings have either lacked or exhibited limited permeability to the aqueous processing solutions, further dictating their back-side placement.

(2) The magnetic recording layers have exhibited significant levels of optical density. In many instances magnetic recording layers are essentially opaque. In other instances the magnetic recording layers exhibit acceptable optical transmission in one region of the spectrum, but not in another. Blue absorption by the magnetic recording layers has been a particular drawback.

(3) The magnetic recording layers have been noted to elevate image granularity when positioned to intercept exposing radiation. The metal oxide (usually ferric oxide) magnetic particles that store magnetic information with the magnetic recording layers exhibit much higher refractive indices than the organic binders in which they are coated and, hence, can contribute significantly to light scattering, depending on their sizes and coating concentrations.

(4) It is generally recognized that the photographic properties of silver halide emulsions are vulnerable to metal contamination. Keller *Science and Technology of Photography*, VCH Publishers, New York, 1993, at page 58 states:

> Even the lowest level of impurities in an emulsion can markedly impair the photographic result. Process equipment, peripheral equipment, and all raw materials used therefore meet strict cleanliness and purity requirements.
>
> Appropriate filtration units must deliver air free of both solid and gaseous contaminants, especially hydrogen sulfide. Water is usually treated on ion-exchange resins and must not contain any reducing agents. The specification of silver nitrate and halides is stringent, especially for heavy-metal impurities: the concentration of iron, copper, and lead must be <1 ppm.

With so many disadvantages to be reduced or eliminated by being able to coat magnetic recording layers of acceptable specular transmittance like other aqueous processing solution permeable layers coated with silver halide emulsion layers, it is not surprising that a few attempts to achieve this objective have been reported along with other, undemonstrated suggestions of such coating possibilities.

Namikawa et al Canadian Patent 686,172 shows that a magnetic recording layer may be transparent to visible light when it contains low concentrations of magnetizable particles. According to this patent, such a layer is coated over a layer containing descriptive material which allows a user to simultaneously hear and see certain subject matter. However, this patent points out that the electromagnetic characteristics, i.e., the magnetic recording and reproducing characteristics, of such a layer are inferior to those of conventional magnetic layers as a result of the very low concentration of-magnetizable particles.

Krall U.S. Pat. No. 3,782,947 discloses a photographic product which carries magnetic particles distributed across the image area of the product at any location, including in front or back side separate layers or in the base or a radiation-sensitive emulsion layer. A variety of silver and non-silver radiation-sensitive materials are disclosed. In every instance in which Krall employs a silver halide emulsion the magnetic recording layer is located on the back side of the support, indicating Krall's awareness of the art-recognized incompatibility of silver halide grains and iron particles.

Yubakami et al U.S. Pat. No. 4,758,275 sets out to overcome the brownish color of magnetic particle dispersions by employing an organic dispersion medium and a colorant. Numerous problems associated with the use of aqueous dispersions of magnetic particles are identified.

Audran et al U.S. Pat. No. 4,279,945 discloses a process of preparing magnetic recording elements containing a recording layer that is transparent over a portion of the visible spectrum. In the Figure transmission is shown to be near zero in the visible wavelength range of from 400 to 500 nm and less than 20 percent at 550 nm, but above 60 percent at 650 nm. Magnetic particle dispersions in organic liquids are employed. The magnetic recording layer is taught to be coated on the back side of the support or over a silver halide emulsion layer. Audran et al further suggests coating over the silver halide emulsion layer and also on the back side of the support.

Bishop et al U.S. Pat. No. 4,990,276 discloses a dispersion consisting essentially of magnetic particles, a dialkylester of phthalic acid, and a dispersing agent. The dispersion is also disclosed to be diluted with organic liquids.

None of the elements of the type described in the above-cited patents have overcome the problems identified above and none of the elements have enjoyed widespread commercial success.

By contrast, Nair et al U.S. Pat. No. 5,457,012 has successfully demonstrated a stable fine solid particle aqueous dispersion which addresses each of problems (1) to (3) above. Nair et al discloses an aqueous medium containing dispersed magnetic particles and an amphiphatic dispersant having a hydrophilic/lipophilic balance of at least 8. Nair et al discloses that the magnetic particles of less than 1 μm in mean size and coating densities of up to 10 mg/dm$^2$ provide acceptable transparency for use in silver halide imaging elements. Nair et al teaches to coat a magnetic recording layer in the support, on the back side of the support, or on the front side of the support over or between silver halide emulsion layers.

SUMMARY OF THE INVENTION

The present invention constitutes an improvement on the teachings of Nair et al, cited above. Specifically, it has been discovered quite surprisingly that the aqueous magnetic particle dispersions of Nair et al can be incorporated in silver halide emulsion layers while maintaining acceptable levels of photographic performance. This runs exactly contrary to the general acceptance within the art that ≧1 ppm iron, based on silver, in a silver halide emulsion layer can create an unacceptable alteration of photographic performance.

The present invention then addresses each of problems (1)–(4) above that have represented barriers to the successful integration of magnetic recording capabilities in aqueous processing solution permeable layers of silver halide photographic elements and particularly silver halide emulsion layers. The present invention eliminates any necessity of resorting to a non-aqueous coating to fabricate a silver halide imaging element and even eliminates any necessity of coating a separate layer for the purpose of providing a magnetic recording capability.

In one aspect, the invention is directed to an imaging element comprised of a support and, coated on the support, at least one radiation-sensitive emulsion layer containing (a) radiation-sensitive silver halide grains and (b) an aqueous processing solution permeable vehicle, wherein the radiation-sensitive emulsion layer additionally contains (c) from 0.1 to 10 mg/dm$^2$ of magnetic particles having a major axis less than 1 μm and, (d) based on the weight of the magnetic particleS, from 10 to 200 percent of an amphipathic dispersant for the magnetic particles having a hydrophilic/lipophilic balance number of at least 8.

In an additional aspect, this invention is directed to an imaging element comprised of a support having first and second major surfaces and, coated on each of the major surfaces of the support, at least one radiation-sensitive emulsion layer containing (a) radiation-sensitive silver halide grains and (b) an aqueous processing solution permeable vehicle, wherein the radiation-sensitive emulsion layer additionally contains (c) from 0.1 to 10 mg/dm$^2$ of magnetic particles having a major axis less than 1 μm and, (d) based on the weight of the magnetic particles, from 10 to 200 percent of an amphipathic dispersant for the magnetic particles having a hydrophilic/lipophilic balance number of at least 8.

DESCRIPTION OF THE PREFERRED EMBODIMENTS

The silver halide imaging elements of the invention have the capability of providing two separate information records in a single silver halide emulsion layer. The first information record is a photographic or radiographic image. The second information record is a magnetic record of the type found in conventional magnetic recording layers.

The simplest form of an element satisfying the requirements of the invention can consist of a single silver halide (AgX) emulsion layer modified for magnetic recording (MR) and a support, illustrated by element SHIE-1 shown below:

| SHIE-1 |
|---|
| MR AgX Emulsion Layer |
| Support |

The support can take the form of any conventional reflective or transparent photographic or radiographic support, as illustrated by *Research Diclosure*, Item 36544, cited above, XV. Supports, and Item 18431, cited above, XII. Film Supports.

The magnetic recording (MR) silver halide (AgX) emulsion layer consists of a radiation-sensitive emulsion layer containing (a) radiation-sensitive silver halide grains, (b) an aqueous processing solution permeable vehicle, (c) from 0.1 to 10 mg/dm$^2$ of magnetic particles having a major axis less than 1 μm and preferably less than the mean equivalent circular diameter (ECD) of the silver halide grains, and (d) based on the weight of the magnetic particles, from 10 to 200 percent of an amphipathic dispersant for the magnetic particles having a hydrophilic/lipophilic balance number of at least 8.

It was unexpected that the magnetic particles in concentrations effective for magnetic recording could be incorporated in the silver halide emulsion while retaining desirable, useful imaging properties. In addition, the amphiphatic dispersant represents an advance in the art in allowing inclusion of the magnetic particles in the aqueous dispersion (the silver halide emulsion) while achieving lower optical densities and imaging granularities than realized in prior attempts to coat magnetic particles from aqueous dispersions.

Notice that in SHIE-1 the silver halide emulsion layer that contains the magnetic information forms one major surface of the element. Hence, magnetic heads used to impart and retrieve the magnetic information do not suffer from signal attenuation attributable to intervening layers.

Instead of constructing the silver halide imaging element with a single silver halide emulsion layer, it has been long recognized that performance advantages can be realized by coating two or more silver halide emulsion layers, illustrated by element SHIE-2 shown below:

| SHIE-2 |
|---|
| First AgX Emulsion Layer |
| Second AgX Emulsion Layer |
| Support |

In SHIE-2 the magnetic recording (MR) capability can be imparted to either the first or second silver halide emulsion layer or both. However, since it is not necessary to distribute the magnetic particles and dispersant through more than one emulsion layer to achieve an acceptable magnetic information record and since the magnetic information record is most easily generated and retrieved from the outermost silver halide emulsion layer, the magnetic particles and dispersant are preferably confined to the first silver halide emulsion layer.

Although not required, it is preferred in practice to provide a surface overcoat (SOC) layer, illustrated by element. SHIE-3 shown below:

| SHIE-3 |
|---|
| Surface Overcoat (SOC) Layer |
| MR AgX Emulsion Layer |
| Support |

The SOC layer can take the form of any conventional SOC layer contained in a photographic or radiographic imaging element. One of the primary functions is to protect the silver halide emulsion layer (or layers) from physical damage in handling. The SOC layer of photographic and radiographic imaging elements also typically contains addenda for modifying the physical handling properties. Addenda of this type are illustrated by *Research Disclosure*, Item 36544, cited above, IX. Coating physical property modifying addenda, A. Coating aids, B. Plasticizers and lubricants, C. Antistats, and D. Matting agents.

It is also well known to provide an SOC layer over a conventional magnetic recording layer to improve the performance of magnetic heads used to generate and retrieve magnetic information. In general any conventional overcoat for a magnetic recording layer that is permeable to the aqueous processing solutions employed for converting a latent image in the silver halide emulsion layer to a viewable image can be employed in the practice of the invention. Such overcoats are disclosed by Nair et al U.S. Pat. No. 5,457,012, cited above and here incorporated by reference, and are further described below.

Since a number of different addenda are often coated over the outermost silver halide emulsion layer, quite frequently a thin interlayer (IL) is coated between the outermost emulsion layer and the SOC layer. SOC addenda that need not be present at the surface of the element to be effective, such as antistats, or addenda that could alternatively be coated in the silver halide emulsion layer are often coated in the interlayer. Even matting agents are sometime introduced in an IL coating. Interlayers that function solely to separate the SOC layer from the outermost emulsion layer are also common. For example, thin interlayers consisting essentially of a hardened vehicle, such as gelatin or a gelatin derivative, are common. Since conventional SOC and IL layers, including vehicle and addenda, together are typically limited to less than 15 mg/dm$^2$, more commonly less than 10 mg/dm$^2$, the minimal spacing that these layers introduce between the outermost, magnetic recording silver halide emulsion layer and the element surface has little, if any, adverse impact on generating or retrieving the magnetic record information.

In practice the silver halide imaging elements of the invention can take many varied forms, depending upon the specific imaging application. In one specific application the silver halide imaging element can be a dual-coated radiographic element, as illustrated by SHIE-4.

| SHIE-4 |
|---|
| SOC Layer |
| Interlayer |
| MR AgX Emulsion Layer |
| Crossover Reduction Layer |
| Transparent Support |
| Crossover Reduction Layer |
| MR AgX Emulsion Layer |
| Interlayer |
| SOC Layer |

The Transparent Support is typically a clear or blue-tinted film support. Neither the SOC Layer nor Interlayer are required, and either or both can be omitted, if desired. The MR AgX Emulsion Layer can take the form of a conventional silver halide emulsion layer to which magnetic particles and dispersant have been added as described above and in further detail below. If desired, only the outermost silver halide emulsion layer on one side of the support need be provided with a magnetic recording capability. The Crossover Reduction Layers are not essential, but highly preferred to increase image sharpness. It has been demonstrated that spectrally sensitized tabular grain silver halide emulsion layers can reduce crossover to less than 20 percent without resorting to other crossover reducing techniques. Crossover Reduction Layers, preferably combined with the use of spectrally sensitized tabular grain emulsion layers, are capable of reducing crossover to less than 10 percent and have been used to reduce crossover to less than measurable levels (less than about 2%).

The dual-coated radiographic elements satisfying the requirements of the invention can in preferred forms be constructed merely by adding a magnetic recording capability to one or both of the outermost silver halide emulsion layers of the dual-coated radiographic elements disclosed in the following patents, here incorporated by reference:

| | |
|---|---|
| Abbott et al | U.S. Pat. No. 4,425,425 |
| Abbott et al | U.S. Pat. No. 4,425,426 |
| Kelly et al | U.S. Pat. No. 4,803,150 |
| Kelly et al | U.S. Pat. No. 4,900,652 |
| Dickerson et al | U.S. Pat. No. 4,994,355 |

-continued

| | |
|---|---|
| Dickerson et al | U.S. Pat. No. 4,997,750 |
| Bunch et al | U.S. Pat. No. 5,021,327 |
| Childers et al | U.S. Pat. No. 5,041,364 |
| Dickerson et al | U.S. Pat. No. 5,108,881 |
| Tsaur et al | U.S. Pat. No. 5,252,442 |
| Steklenski et al | U.S. Pat. No. 5,259,016 |
| Dickerson et al | U.S. Pat. No. 5,399,470 |

In most instances dual-coated radiographic elements are symmetrical in their imaging properties. Thus, customarily the elements have two front sides and no back side, as those terms are employed in referring to photographic elements. Users do not differentiate between the opposite sides of these dual-coated elements during exposure or processing. For this reason the incorporation of a magnetic recording capability in the emulsion layers on each side of the support simplifies manipulative handling. No matter which side of the element is oriented adjacent a magnetic recording head during magnetic record generation, the same record is generated. On read out of a magnetic record formed on only one side of the element, there is a 50 percent chance that, with no knowledge of which side holds the magnetic record, the information will be retrieved on the first pass by a magnetic head provided for information retrieval. If the information is not obtained, the orientation of the element is reversed and the information retrieval step is repeated. If opposed magnetic recording heads are oriented to cover simultaneously both sides of the element, only a single pass across the element is required.

Recently asymmetrical dual-coated radio-graphic elements have come into widespread use. These elements typically require a particular orientation during exposure and hence are often equipped with a marking of some type to distinguish the sides of the element. When a side differentiating marking is provided, only the outermost silver halide emulsion layer on one side of the support need contain a magnetic recording capability. A variety of techniques for differentiating the sides of asymmetrical dual-coated radiographic elements are disclosed by Jebo et al SIR H1105. These side differentiating techniques can also be applied to symmetrical dual-coated radiographic elements to assist in generating and retrieving a magnetic record present in the outermost emulsion layer on only one side of the support.

In a specific preferred form of the invention the radiographic element can be constructed as follows:

| SHIE-5 |
|---|
| SOC Layer |
| Interlayer |
| MR AgX Emulsion Layer |
| AgX Emulsion Layer + Dye |
| Transparent Support |
| AgX Emulsion Layer + Dye |
| MR AgX Emulsion Layer |
| Interlayer |
| SOC Layer |

SHIE-5 differs from SHIE-4 by integrating a portion of the silver halide used for forming the radiographic image with the dye, usually a particulate dye, used for crossover control. This allows the overall level of photographic vehicle to be reduced and facilitates more rapid processing. A specific illustration of a radiographic element of this type is provided by Dickerson et al U.S. Ser. No. 08/446,379, filed May 22, 1995, titled LOW CROSSOVER RADIOGRAPHIC ELEMENTS CAPABLE OF BEING RAPIDLY PROCESSED, commonly assigned. A radiographic element is disclosed having emulsion layers coated on opposite surfaces of a transparent film support. To facilitate rapid processing the emulsion layers are fully forehardened and less than 35 mg/dm$^2$ of hydrophilic colloid is coated on each major surface. To reduce crossover and hydrophitic colloid, emulsions on the opposite sides of the support are each divided into two layers with the layer coated nearest the support containing a particulate dye capable of being decolorized during processing. Particulate dye and silver halide grains together account for between 30 and 70 percent of the total weight of the emulsion layers. Combined with the use of spectrally sensitized tabular grain emulsions, crossover can be reduced to less than 10 percent (preferably less than 5 percent) while processing can be completed in less than 45 seconds (preferably less than 30 seconds). The distribution of hydrophilic colloid and silver halide grains chosen achieves low wet pressure sensitivity.

In addition to dual-coated radiographic elements, radiographic elements are also commonly constructed with one or more silver halide emulsion layers coated on only one side of the support. For example, SHIE-4 and SHIE-5 can be readily converted to single sided formats merely by removing the layers from one side of each support and preferably replacing the removed layers with a pelloid capable of reducing curl. A typical construction of this type is illustrated by the following:

| SHIE-6 |
|---|
| SOC Layer |
| MR AgX Emulsion Layer |
| Antihalation Layer |
| Transparent Support |
| Pelloid |

The Antihalation Layer can be identical to the corresponding Crossover Reducing Layer in the dual-coated elements described above. It still contributes to improving image sharpness, but with silver halide coated on only one side of the support there is no possibility of crossover occurring. The Antihalation Layer and its function can be eliminated, if desired. Dye contained in the Antihalation Layer can alternatively be incorporated in the Pelloid.

It is well understood in the art that silver halide emulsion layers can be employed to form either silver or dye images. Dye imaging in radiography is known, but rarely used. In photography silver and dye imaging are both widely employed. All of the elements described above can be constructed to form either silver or dye images for viewing.

In one form the invention extends to photographic elements for producing multicolor dye images. A typical multicolor dye image forming photographic element construction is illustrated by the following:

| SHIE-7 |
|---|
| SOC Layer |
| 3rd Color Recording Layer Unit |
| 2nd Interlayer (IL-2) |
| 2nd Color Recording Layer Unit |
| 1st Interlayer (IL-1) |
| 1st Color Recording Layer Unit |
| Support |

The Support and the 1st, 2nd and 3rd Color Recording Layer Units are essential components for all color recording applications. The remaining components are either optional or required only in specific applications.

Each of the layer units records exposure in a different one of the blue, green and red portions of the visible spectrum. Any one of the following layer unit sequences are possible:

| | |
|---|---|
| SQ-1 | IBIGIRI S I, |
| SQ-2 | IBIRIGI S I, |
| SQ-3 | IGIRIBI S I, |
| SQ-4 | IRIGIBI S I, |
| SQ-5 | IGIBIRI S I, and |
| SQ-6 | IRIBIGI S I |

where

B=Blue Recording Layer Unit,

G=Green Recording Layer Unit,

R=Red Recording Layer Unit, and

S=Support.

The blue, green and red recording layer units contain a yellow dye-forming coupler, a magenta dye-forming coupler, and a cyan dye-forming coupler, respectively. In addition, each of the layer units contains one, two or three silver halide emulsion layers. Two or three emulsion layers differing in sensitivity are contemplated to be incorporated within a single layer unit. Most commonly the emulsion layers within a layer unit are located so that the faster layers overlie slower layers to arrive at superior speed-granularity relationships and to extend exposure latitude. In is also recognized that higher contrast can be realized by coating slower over faster emulsion layers.

In the practice of the invention the outermost emulsion layer in the 3rd Color Recording Layer Unit contains magnetic particles and dispersant to facilitate magnetic recording. Fortuitously, this layer is most commonly the fastest blue-sensitive emulsion layer. Because of the eye's lower sensitivity to blue than the green and red regions of the spectrum, location of the magnetic recording capability in the outermost blue-recording emulsion layer has a minimal impact on the visually perceived image structure.

In each of the silver halide imaging elements described above having magnetic recording silver halide emulsion layer coated on only one side of the support, it is possible provide a second, conventional magnetic recording layer on the opposite side of the support. Preferably the second magnetic recording layer takes the form disclosed by Nair et al U.S. Pat. No. 5,457,012.

In each of the embodiments of the invention a magnetic recording silver halide emulsion layer is prepared by blending (1) a conventional silver halide emulsion and (2) a stable aqueous dispersion of magnetic particles of the type disclosed by Nair et al U.S. Pat. No. 5,457,012.

In forming the stable aqueous dispersion of magnetic particles, the magnetic particles may comprise, for example, fine ferromagnetic powders such as ferromagnetic gamma-iron oxides, cobalt surface-treated ferromagnetic iron oxides, cobalt-doped ferromagnetic iron oxides, cobalt containing $Fe_2O_3$, ferromagnetic magnetites, cobalt-containing ferromagnetic magnetites, ferromagnetic chromium dioxides, ferromagnetic metal powders, ferromagnetic iron powders, ferromagnetic alloy powders and the class of ferromagnetic ferrite powders including barium ferrites. Additionally, the above mentioned powder particles may be modified to provide lower light extinction and scattering coefficients by providing them with a shell, of at least the same volume as the magnetic core, of a low refractive index material that has its refractive index lower than the transparent polymeric material used to form the magnetizable layer. Typical shell materials may include amorphous silica, vitreous silica, glass, calcium fluoride, magnesium fluoride, lithium fluoride, polytetrafloroethylene and fluorinated resins. Examples of the ferromagnetic alloy powders include those comprising at least 75% by weight of metals which comprise at least 80% by weight of at least one ferromagnetic metal alloy (such as Fe, Co, Ni, Fe—Co, Fe—Ni, Co—Ni, Co—Ni—Fe) and 20% or less of other components (such as Al, Si, S, Sc, Ti, V, Cr, Mn, Cu, Zn, Y, Mo, Rh, Re, Pd, Ag, Sn, B, Ba, Ta, W, Au, Hg, Pb, La, Ce, Pr, Nd, Te, and Bi). The ferromagnetic metals may contain a small amount of water, a hydroxide or an oxide. In addition, magnetic oxides with a thicker layer of lower refractive index oxide or other material having a lower optical scattering cross section as taught in U.S. Pat. No. 5,252,444 may also be used.

The aqueous dispersion contains magnetic particles which have a major axis less than 1 micrometer (μm) and preferably smaller than the mean equivalent circular diameter of the silver halide grains of the emulsion. Limiting the size of the particles in this manner minimizes granularity. The particles are preferably acicular or needle like magnetic particles. The average length of these particles along the major axis preferably is less than about 0.3, more preferably, less than about 0.2 μm. The particles preferably exhibit an axial ratio, that is, a length to diameter thickness ratio of up to about 5 or 6 to 1. Preferred particles have a specific surface area of at least 30 $m^2/g$, more preferably of at least 40 $m^2/g$. Typical acicular particles of this type include, for example, particles of ferro and ferro iron oxides such as γ-ferric oxide, complex oxides of iron and cobalt, various ferrites and metallic iron pigments. Alternatively, small tabular particles such as barium ferrites and the like can be employed. The particles can be doped with one or more ions of a polyvalent metal such as titanium, tin, cobalt, nickel, zinc, maganese, chromium, or the like as is known in the art.

A preferred particle consists of Co surface treated $\gamma$-$Fe_2O_3$ having a specific surface area of greater than 40 $m^2/g$. Particles of this type are commercially available and can be obtained from Toda Kogyo Corporation under the trade names CSF 4085V2, CSF 4565V, CSF 4585V and CND 865V and are available on a production scale from Pfizer Pigments Inc. under the trade designations RPX-4392, RPX-5003, RPX-5026 and RPX-5012. For good magnetic recording, the magnetic particles preferably exhibit coercive force above about 500 Oe and saturation magnetization above 70 emu/g.

The stable aqueous dispersion results from forming a concentrated dispersion of the magnetic particles in water together with a amphipathic dispersant having an HLB number of at least 8, preferably an amphipathic water-dispersible or soluble polymeric dispersant, and milling the resulting mixture in a device such as a ball mill, a roll mill, a high speed impeller mill, media mill, an attritor, a sand mill or the like. Milling is continued for a sufficient time to ensure that substantially no agglomerates of the magnetic particles remain.

The concentration of the magnetic particles in the dispersion is preferably about 5 to about 75%, more preferably about 10 to about 50% and most preferably about 15 to about 35%, the percentages being by weight based on the total weight of the aqueous dispersion.

The milling time required depends on the particular milling device used. In general, milling should be continued from about 0.5 to about 8 hours, preferably from about 1 to about 4 hours.

As mentioned above, the magnetic particles are milled in an aqueous slurry containing an amphipathic dispersant having a hydrophilic/lipophilic balance (HLB) number of at least 8. The HLB number of a dispersant is a measure of the hydrophilic/lipophilic balance of the dispersant and can be determined as described in "Polymeric Surfactants," Surfactant Science Series, volume 42, page 221, by I. Piirma. Preferably the dispersant is polymeric.

The general class of preferred dispersants are water-soluble or water-dispersible polymers represented by one of the following structures.

$$A-B \quad \text{(I)}$$

$$A-B-A \quad \text{(II)}$$

$$-[B]_m-[C]_n- \quad \text{(III)}$$

$$\begin{array}{c} | \\ A \end{array}$$

and $$(AB)_xQ(BA)_z \quad \text{(IV)}$$

wherein each A independently represents 1 to about 150 repeat units of a water-soluble component, B and C each represent a linear or branched alkyl, aryl alkaryl or cyclic alkyl radical containing at least 7 carbon atoms, or 3 to about 100 repeat units of a propylene oxide or higher alkylene oxide or combinations thereof, Q represents a multivalent linking group, m=50–100 mole %, n=1–50 mole %, with the proviso that m+n=100 mole %, x=1 or 2 and z=1 or 2.

A is preferably a poly(ethylene oxide) unit, but can be any other water-soluble unit, such as polyethyloxazoline, poly (vinyl alcohol), poly(vinyl pyrrolidone) or the like. B and C are radicals containing at least 7 carbon atoms, preferably 7 to 500 carbon atoms and more preferably, 15 to 300 carbon atoms. Illustrative radicals include, for example, $C_{20}$–$C_{50}$ alkyl, copolymer of maleic anhydride and an alkene, arylphenoxy, alkylphenoxy, poly(propylene oxide), and poly (butylene oxide). Q is a multivalent linking group having the valence of X+Z. Preferably Q is a polyamine such as ethylene diamine, tetramethylene diamine, a polyhydroxy compound, such as pentaerythritol, or the like.

Generally, dispersants useful in the present invention are well known in the art and some of them are commercially available. Typically the dispersant comprises water-soluble or dispersible block copolymers either linear or branched. Preferred dispersants comprise various poly(ethylene oxide) containing block copolymers. Examples of preferred dispersants are illustrated for example by the ethoxylated compounds as listed below.

| Trade Name | Manufacturer | Chemical Identification | HLB |
|---|---|---|---|
| Unithox ethoxylates | Petrolite | ethoxylated C24–50 n-alkane alcohols | 10–16 |
| Dapral GE202 | Akzo | partial ester of a branched carboxylic acid copolymer | >10 |
| Tetronic 908 | BASF Corporation | block copolymer of poly-(ethylene oxide) and poly(propylene oxide) | >24 |
| Syn Fac 334 | Milliken Chemical | Arylphenol ethoxylate | 11 |
| Syn Fac 8216 | Milliken Chemical | Arylphenol ethoxylate | 15 |
| Syn Fac 8210 | Milliken Chemical | Polyalkoxylated aryl-phenol | 11 |
| Syn Fac 8337 | Milliken Chemical | Potassium salt of a phosphated alkoxylated aryl-phenol | 20 |

More specifically, illustrative preferred dispersants have the following structures:

$CH_3(CH_2)_x(OCH_2CH_2)_zOM$
$x = C_{24}$–$C_{50}$
$z = 8$–$20$
$M = H, SO_3^-X^+$, or $PO_3^{2-}2X^+$
where X is cation such as
$Na^+, K^+, NH_4^+$, etc.

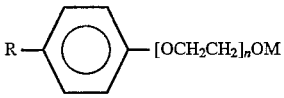

n = 10–25
R = aryl, alkyl, aralkyl
$M = H, SO_3^-$
$X^+$, or $PO_3^{2-}2X^+$
where X is cation such as
$Na^+, K^+, NH_4^+$, etc.

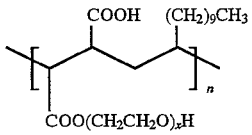

n = 10–20
x = 7–8

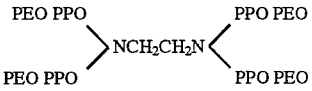

PEO = poly(ethylene oxide)
PPO = poly(propylene oxide)

The preferred dispersants are amphipathic in nature. Such a dispersant comprises in its molecule an oleophilic group of sufficient length to adsorb firmly to the surface of the dispersed particles and also comprises a hydrophilic group of sufficient length to provide a large enough steric barrier to interparticle attraction. The dispersant may be nonionic or ionic in nature. Particularly preferred are dispersants having ionic groups, such as dispersants of the formula:

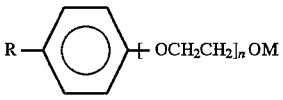

n = 10–25
R = aryl and $M = PO_3^{2-}2X^+$
$X = Na^+, K^+$ or $NH_4^+$.

These amphipathic dispersants are generally block copolymers, either linear or branched and have segmented hydrophilic and oleophilic portions. The hydrophilic segment may or may not comprise ionic groups and the oleophilic segment may or may not comprise polarizable groups. The dispersants utilized in the present invention are believed to function essentially as steric stabilizers in protecting the dispersion against formation of elastic and other flocs leading to increased viscosity of the aqueous dispersion. Ionic groups, if present, in the hydrophilic segment of the polymer provide added colloidal stabilization through ionic repulsion between the dispersed particles of the polymer. The polarizable groups, if present, in the oleophilic segment of the polymer further enhance association of the dispersant through these anchoring sites with certain flocculation-prone solid particles that are polar in nature.

In general, the amount of dispersant used is preferably about 10 to about 200%, more preferably about 20 to about 100% and most preferably about 35 to 75%. The percentages being by weight of the magnetic particles.

In making the dispersion, it may be advantageous to include an ionic small molecule (i.e. nonpolymeric) surfactant for providing added stability through ionic repulsion. These act as antiflocculating agents and are usually ionic in nature. They can be added before or after the milling step. Representative examples of small molecular surfactants are listed below.

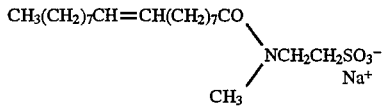

SMS-1 a mixture of:

SMS-2

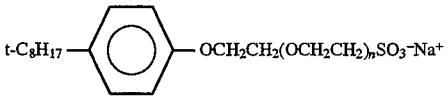

n = 1–3 and

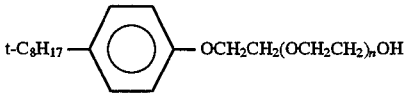

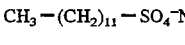

SMS-3

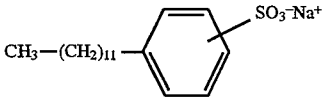

SMS-4

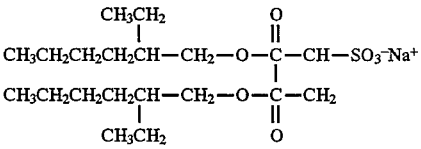

SMS-5

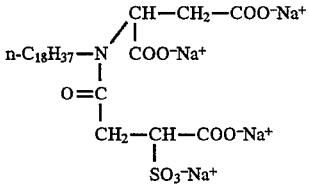

SMS-6

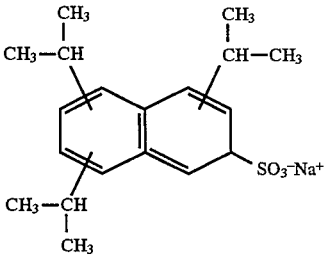

SMS-7

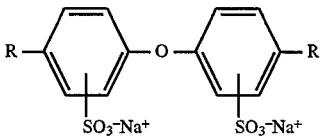

where R = $C_{12}$ branched

SMS-8

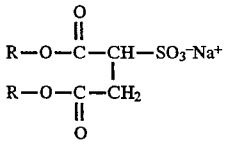

where R = $CH(CH_3)C_4H_9$

SMS-9

-continued

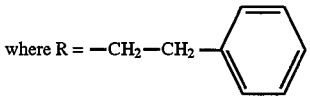

SMS-10

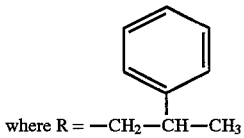

SMS-11 where R = $-CH_2-CH(CH_2CH_3)C_3H_7$ SMS-12 where R = $-(CH_2)_nCH_3$ (n = 2,3&5) SMS-13

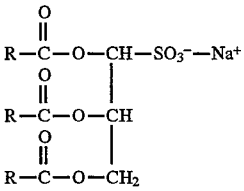

SMS-14

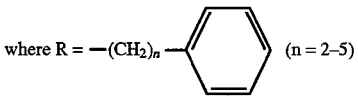

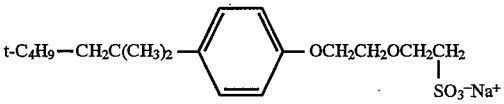

SMS-15

To improve magnetic head performance it is conventional practice to incorporate in the magnetic recording layer abrasive particles. In one preferred form of the invention abrasive particles are included in aqueous dispersion containining the magnetic particles. Examples of abrasive particles include nonmagnetic inorganic powders with a Mohs scale hardness of not less than 6. Specific examples are metal oxides such as α-alumina, chromium oxide (e.g., $Cr_2O_3$), α-ferric oxide (e.g., $Fe_2O_3$), silicon dioxide, alumino-silicate, carbides such as silicon carbide and titanium carbide, nitrides such as silicon nitride, titanium nitride, and diamond in fine powder. α-Alumina and silicon dioxide are the preferred abrasives. These can be pre-dispersed in water using the same dispersants as described in this invention and then incorporated into the coating composition.

Examples of reinforcing filler particles include nonmagnetic inorganic powders with a Mobs scale hardness of at least 6. Specific examples are metal oxides such as γ-aluminum oxide, chromium oxide, (e.g., $Cr_2O_3$), iron oxide (e.g., α-$Fe_2O_3$), silicon dioxide, alumino-silicate, titanium dioxide, carbides such as silicon carbide and titanium carbide, and diamond in fine powder. These can also be pre-dispersed in water using the same dispersants as described above for magnetic particle dispersion and then incorporated into the coating composition.

Particles consisting essentially of tin oxide or doped tin oxide particles, such as, antimony or indium doped tin oxide, can be employed. The tin oxide may be used in either its conductive or non-conductive form; however, when in the conductive form, an additional advantage is gained in that the layer also acts as an antistat. Suitable conductive tin oxide particles are disclosed in Kawaguchi et al U.S. Pat. Nos. 4,394,441 and 4,418,141, Yoshizumi U.S. Pat. No. 4,431,764, Takimoto et al U.S. Pat. No. 4,495,276, and Bishop et al U.S. Pat. No. 4,990,276, the disclosures of which are here incorporated by reference. Useful tin oxide particles are commercially available from Keeling and Walker, Ltd. under the trade designation Stanostat CPM 375; DuPont Co. under the trade designation Zelec-ECP 3005XC and 3010SC and Mitsubishi Metals Corp. under the trade designation T-1.

Metal antimonate particles are also contemplated for incorporation. Preferred metal antimonates include those having rutile or rutile-related crystallographic structures, such as those described in Christian et al U.S. Pat. No. 5,368,995, the disclosure of which is here incorporated by reference.

In blending the stable aqueous dispersion (2) above with a silver halide emulsion (1), the ratios are selected so that, when the silver halide is coated in its intended, conventional coating coverage, the magnetic particle coating coverage ranges from 0.1 to 10 mg/dm$^2$. Radiographic elements and black-and-white photographic elements containing a single silver halide emulsion layer intended to form a maximum density of from 3.0 to 4.0 as a developed silver image seldom require more than 30 mg/dm$^2$ of silver in the form of radiation-sensitive silver halide grains. On the other hand, when magnetic recording silver halide emulsion layer is only one of several emulsion layers, it is appreciated that much lower silver coverages are possible. Usually a silver or dye image forming emulsion layer used in combination with other emulsion layers for overall image formation contains at least about 1.0 and, more commonly, at least 3 mg/dm$^2$ silver. It is well known in redox dye image amplification systems to create a dye image using developed silver as a redox catalyst. In such systems silver coverages typically range down to 0.1 mg/dm$^2$ or less. Such systems are described in *Research Disclosure*, Item 36544, cited above, XVIII. Chemical development systems, B. Color-specific processing systems, sub-paragraph (5).

The silver halide emulsion (1) that is blended with the stable aqueous dispersion (2) can take any convenient conventional form. The various choices of radiation-sensitive silver halide grains and their preparation are described in *Research Diclosure*, Item 36544, cited above, I. Emulsion grains and their preparation. Naming mixed halides in order of increasing concentrations, silver bromide, iodobromide, chlorobromide, iodochlorobromide, chloroiodobromide, bromochloride, iodochloride, iodobromochloride and bromoiodochloride radiation-sensitive grain compositions are all contemplated. For radiographic applications it is preferred that the grains contain less than 3 mole percent iodide, based on silver. Silver bromide grains are commonly employed for radiographic imaging. For reflection print elements high (>50 mole %) chloride grains are preferred and iodide concentrations are usually minimized (<2 mole %). For camera-speed photographic elements silver iodobromide grains are most commonly employed, with iodide concentrations preferably being limited to less than 10 mole %. All halide mole % values are referenced to total silver.

In a specifically preferred from the radiation silver halide grains are chosen from among conventional tabular grain emulsions. Tabular grains are those which have an aspect ratio of at least 2, where "aspect ratio" is the ratio of the equivalent circular diameter of the grain divided by its thickness. Tabular grain emulsions are those in which tabular grains account for at least 50 percent (preferably at least 70 percent, and optimally at least 90%) of total grain projected area. Preferred tabular grain emulsions are those in which tabular grains having a thickness of less than 0.3 μm (preferably <0.2 μm) have an average aspect ratio of >5 and preferably >8.

The radiation-sensitive grains are almost invariably chemically sensitized and, in most instances, spectrally sensitized. Chemical and spectral sensitization can be undertaken as described in the following:

Research Diclosure

Item 36544
IV. Chemical Sensitization
V. Spectral sensitization and desensitization
Vol. 370, February 1995, Item 37038
XV. Emulsions, including particularly,
E. Spectral sensitization
F. Structures of Typical Sensitizing Dyes The silver halide grains rely on the presence of a peptizer for stable dispersion in the aqueous medium in which they are precipitated. Following precipitation and in preparation for coating binder (which can be identical in composition to the peptizer) is added to the emulsion composition. The peptizer and binder together are collectively form the emulsion vehicle. The silver halide emulsion layers and other layers of the silver halide imaging elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agaragar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787, 545 and 2,956,880, Himmelmann et al U.S. Pat. No. 3,061, 436, Farrell et al U.S. Pat. No. 2,816,027, Ryan U.S. Pat. Nos. 3,132,945, 3,138,461 and 3,186,846, Dersch et al U.K. Patent 1,167,159 and U.S. Pat. Nos. 2,960,405 and 3,436, 220, Geary U.S. Pat. No. 3,486,896, Gazzard U.K. Patent 793,549, Gates et al U.S. Pat. Nos. 2,992,213, 3,157,506, 3,184,312 and 3,539,353, Miller et al U.S. Pat. No. 3,227, 571, Boyer et al U.S. Pat. No. 3,532,502, Malan U.S. Pat. No. 3,551,151, Lohmer et al U.S. Pat. No. 4,018,609, Luciani et al U.K. Patent 1,186,790, U.K. Patent 1,489,080 and Hori et al Belgian Patent 856,631, U.K. Patent 1,490, 644, U.K. Patent 1,483,551, Arase et al U.K. Patent 1,459, 906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Patent 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Patent 15,727, Stevens U.K. Patent 1,062,116, Yamamoto et al U.S. Pat. No. 3,923,517 and Maskasky U.S. Pat. No. 5,284,744.

Relatively recent teachings of gelatin and hydrophilic colloid peptizer modifications and selections are illustrated by Moll et al U.S. Pat. Nos. 4,990,440 and 4,992,362 and EPO 0 285 994, Koepff et al U.S. Pat. No. 4,992,100, Tanji et al U.S. Pat. No. 5,024,932, Schulz U.S. Pat. No. 5,045, 445, Dumas et al U.S. Pat. No. 5,087,694, Nasrallah et al U.S. Pat. No. 5,210,182, Specht et al U.S. Pat. No. 5,219, 992, Nishibori U.S. Pat. Nos. 5,225,536, 5,244,784, Tavernier EPO 0 532 094, Kadowaki et al EPO 0 551 994, Sommerfeld et al East German DD 285 255, Kuhrt et al East German DD 299 608, Wetzel et al East German DD 289 770 and Farkas U.K. Patent 2,231,968.

Where the peptizer is gelatin or a gelatin derivative it can be treated prior to or during emulsion precipitation with a methionine oxidizing agent. Examples of methionine oxidizing agents include NaOCl, chloramine, potassium monopersulfate, hydrogen peroxide and peroxide releasing compounds, ozone, thiosulfates and alkylating agents. Specific illustrations are provided by Maskasky U.S. Pat. Nos. 4,713,320 and 4,713,323, King et al U.S. Pat. No. 4,942,120, Takada et al EPO 0 434 012 and Okumura et al EPO 0 553 622.

The imaging elements and particularly the gelatin and gelatin derivative containing layers of the imaging elements can be protected against biological degradation by the addition of agents for arresting biological activity (biocides and/or biostats), such as illustrated by Kato et al U.S. Pat. No. 4,923,790, Sasaki et al U.S. Pat. No. 4,997,752, Miyata et al U.S. Pat. No. 5,185,240, Noguchi et al U.S. Pat. No. 5,198,329, Wada EPO 0 331 319, Ogawa et at EPO 0 429 240, Meisel East German DD 281,265, Jäkel et al East German DD 298,460, Hartmann et al East German 299,063 and Cawse U.K. Patent 2,223,859.

The layers of the imaging elements containing cross-linkable colloids, particularly the gelatin-containing layers, can be hardened by various organic and inorganic hardeners, such as those described in T. H. James, *The Theory of the Photographic Process,* 4th Ed., MacMillan, 1977, pp. 77–87. The hardeners can be used alone or in combination and in free or in blocked form.

Typical useful hardeners include formaldehyde and free dialdehydes such as succinaldehyde and glutaraldehyde as illustrated by Allen et al U.S. Pat. No. 3,232,764; blocked dialdehydes as illustrated by Kaszuba U.S. Pat. No. 2,586,168, Jeffreys U.S. Pat. No. 2,870,013 and Yamamoto et al U.S. Pat. No. 3,819,608; adiketones as illustrated by Allen et al U.S. Pat. No. 2,725,305; active esters of the type described by Burness et al U.S. Pat. No. 3,542,558; sulfonate esters as illustrated by Allen et al U.S. Pat. Nos. 2,725,305 and 2,726,162; active halogen compounds as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861 and Vermeersch et al U.S. Pat. No. 4,879,209; s-triazines and diazines as illustrated by Yamamoto et al U.S. Pat. No. 3,325,287, Anderau et al U.S. Pat. No. 3,288,775, Stauner et al U.S. Pat. No. 3,992,366, Terashima et al U.S. Pat. No. 5,102,780 and Komorita et al EPO 0 244 184; epoxides as illustrated by Allen et al U.S. Pat. No. 3,047,394, Burness U.S. Pat. No. 3,189,459, Vermeersch et al U.S. Pat. No. 4,820,613, Komorita 4,837,143, Helling et al EPO 0 301 313 and Birr et al German OLS 1,085,663; aziridines as illustrated by Allen et al U.S. Pat. No. 2,950,197, Burness et al U.S. Pat. No. 3,271,175 and Sato et al U.S. Pat. No. 3,575,705; active olefins having two or more active bonds as illustrated by Burness et al U.S. Pat. Nos. 3,490,911, 3,539,644 and 3,841,872 (Reissue 29,305), Cohen U.S. Pat. No. 3,640,720, Kleist et al German OLS 872,153, Allen U.S. Pat. No. 2,992,109, Itahasi et al U.S. Pat. No. 4,874,687, Okamura et al U.S. Pat. No. 4,897,344, Ikenoue et al U.S. Pat. No. 5,071,736, Delfino et al U.S. Pat. No. 5,246,824 and Helling et al German OLS 3,724,672; blocked active olefins as illustrated by Burness et al U.S. Pat. No. 3,360,372, Wilson U.S. Pat. No. 3,345,177 and Himmelman et al U.S. Pat. Nos. 4,845,0234 and 4,894,324; carbodiimides as illustrated by Blout et al German Patent 1,148,446; isoxazolium salts unsubstituted in the 3-position as illustrated by Burness et al U.S. Pat. No. 3,321,313; esters of 2-alkoxy-N-carboxydihydroquinoline as illustrated by Bergthaller et al U.S. Pat. No. 4,013,468; N-carbamoyl pyridinium salts as illustrated by Himmelmann et al U.S. Pat. Nos. 3,880,665 and 4,063,952, Okamura et al U.S. Pat. No. 4,828,974, Schranz et al U.S. Pat. No. 4,865,940, Roche et al U.S. Pat. No. 4,978,607, Schweicher et al U.S. Pat. Nos. 4,942,068 and Helling et al EPO 0 370 226; carbamoyl oxypyridinium salts as illustrated by Bergthaller et al U.S. Pat. No. 4,055,427; bis(imoniomethyl) ether salts, particularly bis(amidino) ether salts, as illustrated by Chen et al U.S. Pat. No. 4,877,724 and Riecke et al WO 90/02357, surface-applied carboxyl-activating hardeners in combination with complex-forming salts as illustrated by Sauerteig et al U.S. Pat. No. 4,119,464; carbamoylonium, carbamoyl pyridinium and carbamoyl oxypyridinium salts in combination with certain aldehyde scavengers as illustrated by Langen et al U.S. Pat. No. 4,418,142; dication ethers as illustrated by Chen et al European Patent Application EP 281,146; hydroxylamine esters of imidic acid salts and chloroformamidinium salts as illustrated by Okamura et al U.S. Pat. Nos. 4,612,280 and 4,673,632; hardeners of mixed function such as halogen-substituted aldehyde acids (e.g., mucochloric and mucobromic acids) as illustrated by White U.S. Pat. No. 2,080,019, 'onium-substituted acroleins, as illustrated by Tschopp et al U.S. Pat. No. 3,792,021, and vinyl sulfones containing other hardening functional groups as illustrated by Sera et al U.S. Pat. No. 4,028,320; and polymeric hardeners such as dialdehyde starches as illustrated by Jeffreys et al U.S. Pat. No. 3,057,723, and copoly(acrolein-methacrylic acid) as illustrated by Himmelmann et al U.S. Pat. No. 3,396,029.

The use of hardeners in combination is illustrated by Sieg et al U.S. Pat. No. 3,497,358, Dallon et al U.S. Pat. Nos. 3,832,181 and 3,840,370, Yamamoto et al U.S. Pat. No. 3,898,089, Miyoshi et al U.S. Pat. No. 4,670,377 and Jerenz U.S. Pat. No. 4,944,966. Hardening accelerators can be used as illustrated by Sheppard et al U.S. Pat. No. 2,165,421, Kleist German OLS 881,444, Riebel et al U.S. Pat. No. 3,628,961 and Ugi et al U.S. Pat. No. 3,901,708. Tabular grain radiographic materials for rapid processing can be hardened during manufacture while retaining good covering power, as illustrated by Dickerson U.S. Pat. No. 4,414,304.

More recent teachings pertaining to hardeners that fit none of the groupings discussed above are illustrated by Nakamura et al U.S. Pat. No. 4,921,785, Wolff et al U.S. Pat. No. 4,939,079, Chino et al U.S. Pat. No. 4,962,016, Sato et al U.S. Pat. No. 4,999,282, Reif et al U.S. Pat. No. 5,034,249, Kok et al U.S. Pat. No. 5,073,480, Riecke et al U.S. Pat. No. 5,236,822, Ohtani et al EPO 0 384 668, Moriya et al EPO 0 444 648, Hattori EPO 0 457 153, Rüger EPO 0 519 329, Langen et al German OLS 3,740,930 and Eeles et al WO 92/12463.

Emulsion layers and other layers of the imaging elements such as overcoat layers, interlayers and subbing layers can also contain alone or in combination with hydrophilic water-permeable colloids as vehicles or vehicle extenders (e.g., in the form of latices), synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkyl sulfonic acid copolymers, sulfoalkyl acrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides, compounds containing semicarbazone or alkoxy carbonyl hydrazone groups, polyester latex compositions, polystyryl amine polymers, vinyl benzoate polymers, carboxylic acid amide latices, copolymers containing acrylamidophenol cross-linking sites, vinyl pyrrolidone, colloidal silica and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Patent 774,054, Ream et al U.S. Pat. No. 3,287,289, Smith U.K. Patent 1,466,600, Stevens U.K. Patent 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Patent 1,348,815, Taylor et al U.S. Pat. No. 3,479,186, Merrill et al U.S. Pat. No. 3,520,857, Plakunov U.S. Pat. Nos. 3,589,908 and 3,591,379, Bacon et al U.S. Pat. No. 3,690,888, Bowman U.S. Pat. No. 3,748,143, Dickinson et al U.K. Patents 808,227 and '228, Wood U.K. Patent 822,192 and Iguchi et al U.K. Patent 1,398,055, DeWinter et al U.S. Pat. No. 4,215,196, Campbell et al U.S. Pat. No. 4,147,550, Sysak U.S. Pat. No. 4,391,903, Chen U.S. Pat. No. 4,401,787, Karino et al U.S. Pat. No. 4,396,698, Fitzgerald U.S. Pat. No. 4,315,071, Fitzgerald et al U.S. Pat. No. 4,350,759, Helling U.S. Pat. No. 4,513,080, Brück et al U.S. Pat. No. 4,301,240, Campbell et al U.S. Pat. No. 4,207,109, Chuang et al U.S. Pat. No. 4,145,221, Bergthaller et al U.S. Pat. No. 4,334,013, Helling U.S. Pat. No. 4,426,438 and Iwagaki et al EPO 0 131 161.

Recent illustrations of synthetic polymers, especially latex polymers, added to various layers of imaging elements to achieve specific results, such as, to increase viscosity, to reduce curl, to decrease pressure sensitivity, to increase dimensional stability, to prevent color stain, to improve dryability and scratch resistance, to deliver materials to prevent wandering of filter dyes, to promote flocculation or coagulation and as binders, are provided by Roth (et al) German DE Patent 4,034,871 and East German DD 295,420, Sasaki et al 4,975,360, Dappen et al U.S. Pat. No. 5,015,566, Kraft et al U.S. Pat. No. 5,070,006, Factor U.S. Pat. Nos. 5,006,450 and 5,077,187, Ono et al. U.S. Pat. No. 4,983,506, Kawai U.S. Pat. No. 4,914,012, Hatakeyama et al U.S. Pat. No. 5,219,718, Hesse et al German OLS 276,743, Metoki et al EPO 0 319 920, Arai (et al) EPO 0 477 670 and EPO 0 510 961 and Nair et al EPO 0 552 802.

The dyes contained in the Crossover Reduction and Antihalation Layers above can take any of the forms described in the following:

Item 18431
V. Cross-Over Exposure Control

Item 36544
VIII. Absorbing and scattering materials
B. Absorbing materials
C. Discharge Item 37038
XIII. Filter and Absorber Dyes In addition to the various addenda to the emulsion and other layers of the imaging elements noted above, it is appreciated that other conventional addenda can and, in most instances, will also be present. These addenda can take any conventional form. They include the various addenda disclosed by *Research Disclosure* Items 18431, 36544, and 37038, each cited above.

EXAMPLES

The invention can be better appreciated by reference to the following specific embodiments.

Examples 1–6

The following examples illustrate the preparation of stable aqueous dispersions of magnetic particles and transparent magnetic recording layers in accordance with this invention.

Example 1

A finely divided concentrate of a magnetic material was made by milling 20 parts of Co-surface treated-γ-iron oxide powder supplied by Toda Kogyo under the trade designation CSF 4085V2, major axis mean particle size 0.2–0.25 μm and 20 parts of a 50% by weight solution of the dispersant Syn Fac 8337 (sold by Milliken Chemical) in 70 parts deionized water in a small media mill. The sample was milled for 1–1.5 hours until the average particle size was down to 0.25 μm.

Example 2

The dispersion from Example 1 in the amount of 0.225 g was added to 14.7 g of a 10% aqueous solution of deionized cow bone gelatin at 39° C., and the mixture was stirred at that temperature to yield a fine dispersion of ferric oxide in gelatin. The dispersion thus obtained was treated with 0.55 g of 10% nonylphenoxy polyglycerol (obtained from Olin under the trade designation Olin 10 G), a coating aid, and coated on a gel subbed cellulose triacetate support at room temperature using a coating knife with a spacing of 0.0015 inch ($3.8\times10^{-3}$ cm) and dried at room temperature.

Example 3

The dispersion from Example 1 in the amount of 0.45 g was added to gelatin and coated as described in Example 2.

Example 4

The dispersion from Example 2 was treated with (2% by weight with respect to gelatin) bis(vinylsulfonylmethyl) ether (BVSME) hardener prior to coating on the support and dried at 55° C. in air.

Example 5

A dispersion of 0.21 μm α-alumina abrasive particles (commercially available from Sumitomo Chemical Company under the designation AKP50) was prepared in water by ball milling 25 g AKP50, 10 g of a 50% by weight solution of Syn Fac 8337 and 75 g deionized water.

The dispersion from Example 2 was treated with a portion of the AKP50 dispersion described above such that the abrasive particles made up 0.235% of the total. This was coated as in Example 2.

Example 6

(comparative)

A comparative coating of magnetic particles was prepared as described in Example 7 of U.S. Pat. No. 5,217,804. First, a dispersion of magnetic particles, in methylene chloride, methyl alcohol, and butanol was prepared. Cellulose triacetate was added and the resulting composition was coated onto a cellulose ester film support.

Photomicrographs of the coatings of Examples 2 to 6 inclusive, shown in Nair et al U.S. Pat. No. 5,457,012 as FIGS. 1 to 5 inclusive, respectively, show that the aqueous dispersions of magnetic particles satisfying the requirements of the invention produced layers in which the magnetic particles were as well dispersed as when the conventional, non-aqueous coating composition of Example 6 was employed. This demonstrates the effectiveness of the dispersants contemplated by this invention to form stable aqueous dispersions with the magnetic particles.

Examples 7–13

These examples demonstrate the construction of silver halide imaging elements satisfying the requirements of the invention.

A series of imaging elements were constructed having the following general structure:

| |
|---|
| SOC Layer |
| Interlayer |
| AgX Emulsion Layer |
| Blue Tinted Transparent Support |

Element A (control)

| | Level (mg/dm$^2$) |
|---|---|
| SOC Layer | |
| Gelatin | 3.4 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |
| Polymeric thickener | 0.23 |
| Interlayer | |
| Gelatin | 3.4 |
| AgI (0.08 μm, mean ECD) | 0.11 |
| Carboxymethyl casein | 0.57 |
| Colloidal, silica | 0.57 |
| Polyacrylamide | 0.57 |
| Chrome alum | 0.025 |
| Resorcinol | 0.058 |
| Nitron | 0.044 |
| Polymeric thickener | 0.23 |
| Agx Emulsion Layer | |
| AgBr | 21.8 |
| Gelatin | 32.7 |
| 5-Bromo-4-hydroxy-6-methyl- | 0.2 mg/Ag mole |

-continued

| | Level (mg/dm$^2$) |
|---|---|
| 1,3,3A,7-tetraazaindene | |
| 4-Hydroxy-6-methyl-1,3,3A,7-tetraazaindene | 2.1 mg/Ag mole |
| Potassium nitrate | 1.8 |
| Ammonium hexachloropalladate | 0.0022 |
| Maleic acid hydrazide | 0.0087 |
| Potassium bromide | 0.14 |
| Disulfocatechol | 0.17 |
| BVSME | 2.4 wt. %, based on total gelatin |

The Support was a blue tinted 7 mil (158 mm) transparent poly(ethylene terephathalate) radiographic film support. The AgI was added in the form of a Lippmann emulsion. The AgBr was in the form of a silver bromide tabular grain emulsion in which >50% of total grain projected area was accounted for by tabular grains having a mean ECD of 1.8 μm and an average thickness of 0.13 μm. The AgBr grains were sulfur and gold sensitized and spectrally sensitized with 400 mg/Ag mole of anhydro-5,5'-dichloro-9-ethyl-3,3'-bis(3-sulfopropyl)oxacarbocyanine hydroxide, followed by the addition of 300 mg/Ag mole of KI, to improve dye adsorption to the grain surfaces.

Element B (example)

Element B was identical to Element A, except that the following were additionally added:

| AgX Emulsion Layer | Level (mg/dm$^2$) |
|---|---|
| Dispersant (Syn Fac 8337) | 0.3 |
| γ-Iron Oxide (Toda CSF-4085V2) | 0.6 |

Element C (example)

Element C was identical to Element B, except that the SOC Layer was replaced with a magnetic recording layer overcoat (MROC) layer:

| MROC Layer | Level (mg/dm$^2$) |
|---|---|
| Gelatin | 0.83 |
| carnauba wax | 1.9 |
| Polystyrene sulfonic acid, sodium salt | 0.065 |

Element D (control)

Element D exhibited the following structure:

| |
|---|
| AgX Emulsion Layer |
| Clear Transparent Support |

| AgX Emulsion Layer | Level (mg/dm$^2$) |
|---|---|
| Gelatin | 42.0 |
| AgBr | 21.5 |
| BVSME | 1.4 wt. %, based on total gelatin |

Clear Transparent Support 7 mil (178 mm) poly(ethylene terephthalate) film support The same silver bromide tabular grain emulsion was employed as in the previous elements.

Element E (example)

Element E was identical to Element D, except that the following were additionally added:

| AgX Emulsion Layer | Level (mg/dm$^2$) |
|---|---|
| Dispersant (Syn Fac 8337) | 0.3 |
| γ-Iron Oxide (Toda CSF-4085V2) | 0.6 |

Element F (example)

Element F was identical to Element D, except that the following were additionally added:

| AgX Emulsion Layer | Level (mg/dm$^2$) |
|---|---|
| Dispersant (Syn Fac 8337) | 0.3 |
| γ-Iron Oxide (Toda CSF-4085V2) | 0.6 |
| Disulfocatechol | 0.17 |

Dissulfocatechol is a known iron sequestering agent (ISA). By adding and withholding the ISA from identical elements containing the iron oxide magnetic particles, an improvement in performance in the ISA containing element, if observed, would provide evidence that the iron oxide magnetic particles were degrading imaging performance.

Element G (control)

Element G was identical to Element D, except that a 4 mole % I, based on silver, silver iodobromide tabular grain emulsion was substituted for the silver bromide tabular grain emulsion. The AgIBr tabular grains accounted for >50% of total grain projected area and exhibited a mean ECD of 2.2 μm and a mean thickness of 0.13 μm.

Element H (example)

Element H was identical to Element G, except that the following were additionally added:

| AgX Emulsion Layer | Level (mg/dm$^2$) |
|---|---|
| Dispersant (Syn Fac 8337) | 0.3 |
| γ-Iron Oxide (Toda CSF-4085V2) | 0.6 |

Element I (example)

Element H was identical to Element G, except that the following were additionally added:

| AgX Emulsion Layer | Level (mg/dm$^2$) |
|---|---|
| Dispersant (Syn Fac 8337) | 0.3 |
| γ-Iron Oxide (Toda CSF-4085V2) | 0.6 |
| Disulfocatechol | 0.17 |

Exposure

Each of the elements were exposed through a graduated density step tablet in a MacBeth sensitometer for 1/50th second to a 500 watt General Electric DMX projector lamp calibrated to a color temperature of 2650° K., filtered through Corning C4010 filter to simulate the 545 to 550 nm peak green light emission of an intensifying screen containing a europium activated gadolinium oxysulfide phosphor.

Processing

Each exposed elements were processed in a Kodak RP X-Omat™ processor in 90 seconds in the following manner:

| | |
|---|---|
| development | 24 seconds at 40° C., |
| fixing | 20 seconds at 40° C., |
| washing | 10 seconds at 40° C., |
| drying | 20 seconds at 65° C. |

where the remaining time is taken up by transport between processing steps, the development step employing the following developer:

| | |
|---|---|
| Hydroquinone | 30.0 g |
| 1-Phenyl-3-pyrazolidone | 1.5 g |
| Potassium hydroxide | 21.0 g |
| Sodium bicarbonate | 7.5 g |
| Potassium sulfite | 44.2 g |
| Sodium meta-bisulfite | 12.6 g |
| 5-Methylbenzotriazole | 0.06 g |
| Glutaraldehye | 4.9 g |
| Water to 1 liter, pH 10, | |

the fixing step employed the following fixing composition:

| | |
|---|---|
| Ammonium thiosulfate | 260.0 g |
| Sodium bisulfite | 180.0 g |
| Boric acid | 25.0 g |
| Acetic acid | 10.0 g |
| Aluminum sulfate | 8.0 g |
| Water to 1 liter, pH 3.9 to 4.5. | |

Sensitometry

Optical densities are expressed in terms of diffuse density as measured by a an X-rite Model 310™ densitometer, which was calibrated to ANSI standard PH 2.19 and was traceable to a National Bureau of Standards calibration step tablet. Minimum density (Dmin) is the minimum density exhibited by the exposed and processed element; it is the combined density of the support and coated layers. Net fog is Dmin minus the density of the support (0.2). Maximum density (Dmax) was measured similarly as Dmin.

A characteristic curve (density vs. log E, where E represents exposure in lux-seconds) was plotted for each exposed and processed element. Speed was measured at a density of 1.0 over Dmin. Speed is reported in relative log units. That is, the speed of the control element is set at 100 and each unit difference in speed exhibited by the example element represents a speed difference of 0.01 log E. Contrast is reported as the slope of a line drawn on the characteristic curve from Dmin+0.25 to Dmin+2.5.

The results observed are summarized below in Tables I and II.

TABLE I

| | AgX Emulsion Layer | | | | Relative | Net |
|---|---|---|---|---|---|---|
| Element | AgX | $Fe_2O_3$ | ISA | SOC | Speed | Fog |
| A | AgBr | No | No | HC | 100 | 0.07 |
| B | AgBr | Yes | No | HC | 96 | 0.15 |
| C | AgBr | Yes | No | WAX | 102 | 0.17 |
| D | AgBr | No | No | None | 100 | 0.05 |
| E | AgBr | Yes | No | None | 94 | 0.08 |
| F | AgBr | Yes | Yes | None | 102 | 0.08 |
| G | AgIBr | No | No | None | 100 | 0.18 |
| H | AgIBr | Yes | No | None | 86 | 0.81 |
| I | AgIBr | Yes | Yes | None | 99 | 0.19 |

HC = Conventional imaging element hydrophilic colloid overcoat
WAX = Conventional wax containing overcoat for magnetic recording layer

TABLE II

| Element | Contrast | Dmin | Dmax |
|---|---|---|---|
| A | 2.80 | 0.27 | 3.9 |
| B | 2.92 | 0.35 | 4.1 |
| C | 2.90 | 0.37 | 4.0 |

The magnetic particles left a residual brown color in the elements. In the elements containing silver bromide emulsions the stain translated to a net elevation in fog of from 0.08 to 0.10 in Elements B and C, but only 0.01 to 0.03 in the remaining silver bromide containing elements. All of these fog levels were acceptable. The magnetic particles had no clear cut effect on speed or contrast in the elements containing silver bromide emulsions. The silver iodobromide emulsion exhibited a higher net fog and a significantly lower relative speed when the iron oxide was incorporated in the emulsion in the absence of the iron sequestering agent, disulfocatechol. The iron sequestering agent reduced the net fog to within 0.01 of its original value in the absence of the iron oxide particles and increased speed to within 0.01 log E of its original value in the absence of the iron oxide particles. Thus, the photographic performance degradation attributable to the incorporation of iron oxide particles in the silver iodobromide emulsion was reduced to an insignificantly low level by iron sequestering agent addition.

From this data it is concluded that the inclusion of an iron sequestering agent has no adverse effect and, depending on the specific coating and its composition, may have an advantageous effect. It is therefore specifically contemplated to include, in the emulsion layer containing the magnetic particles a sequestering agent. Conventional antifoggants and stabilizers, including metal ion sequestering agents contemplated for inclusion in the silver halide emulsion layers are disclosed in *Research Disclosure*, Item 36544, cited above, VII. Antifoggants and stabilizers, particularly sub-paragraph (5). Sufocatechol-type compounds are illustrated by Kennard et al U.S. Pat. No. 3,236,652; aldoximines are illustrated by Carroll et al U.K. Patent 623,448; metaphosphates and polyphosphates are illustrated by Draisbach U.S. Pat. No. 2,239,284; and carboxylic acids, such as ethylenediamine tetraacetic acid (EDTA) are illustrated by U.K. Patnet 691,715.

Surprisingly, the hydrophobic carnauba wax containing overcoat employed as an overcoat for magnetic recording layers did not significantly change imaging performance as compared to the use of a conventional imaging element hydrophilic colloid overcoat.

Magnetic Recording

Elements B and C were magnetically encoded using a 158 mm bit density recorder. Evaluation of the magnetic encoding confirmed that the elements were capable of providing a retrievable record of magnetic information.

The invention has been described in detail with particular reference to preferred embodiments thereof, but it will be understood that variations and modifications can be effected within the spirit and scope of the invention.

What is claimed is:

1. An imaging element comprised of a support and, coated on the support, at least one radiation-sensitive emulsion layer containing (a) radiation-sensitive silver halide grains and (b) an aqueous processing solution permeable vehicle, wherein the radiation-sensitive emulsion layer additionally contains (c) from 0.1 to 10 mg/dm$^2$ of magnetic particles having a major axis less than 1 μm and (d) based on the weight of the magnetic particles, from 10 to 200 percent of an amphipathic dispersant for the magnetic particles having a hydrophilic/lipophilic balance number of at least 8.

2. An imaging element according to claim 1 wherein at least two radiation-sensitive emulsion layers are coated on the support.

3. An imaging element according to claim 2 wherein the two radiation-sensitive emulsion layers are coated on the same side of the support and the one emulsion layer is the outermost emulsion layer.

4. An imaging element according to claim 2 wherein the support is a transparent film support and the two radiation-sensitive emulsion layers are coated on opposite sides of the support.

5. An imaging element according to claim 4 wherein each of the two radiation-sensitive emulsion layers satisfy (c) and (d).

6. An imaging element according to claim 1 wherein the average length of the major axis of the magnetic particles is less than the average equivalent circular diameter of the silver halide grains.

7. An imaging element according to claim 1 wherein the average length of the major axis of the magnetic particles is less than 0.3 μm.

8. An imaging element according to claim 1 wherein at least said one emulsion layer contains a sequestering agent.

9. An imaging element according to claim 8 wherein said one emulsion layer contains silver iodobromide grains.

10. An imaging element according to claim 1 wherein the dispersant is selected from the group of amphipathic water-soluble or water-dispersible polymers represented by one of the following structures:

$$A-B \quad \text{(I)}$$

$$A-B-A \quad \text{(II)}$$

$$-[B]_m-[C]_n- \quad \text{(III)}$$

$$\begin{array}{c} | \\ A \end{array}$$

and $$(AB)_xQ(BA)_z \quad \text{(IV)}$$

wherein each A independently represents 1 to about 150 repeat units of a water-soluble component, B and C each represent a linear or branched alkyl, aryl alkaryl or cyclic alkyl radical containing at least 7 carbon atoms, or 3 to about 100 repeat units of a propylene oxide or higher alkylene oxide or combinations thereof, Q represents a multivalent linking group m=50–100 mole % and n=1–50 mole %, with the proviso that m+n=100 mole %, x=1 or 2 and z=1 or 2.

11. An imaging element according to claim 9 wherein the dispersant has the formula:

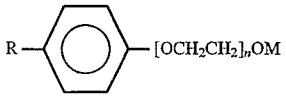

-continued n = 10–25
R = aryl, alkyl, arakyl
M = H, $SO_3^-X^+$
or $PO_3^{2-}2X^+$
where X is cation.

12. An imaging element of claim 11 wherein the dispersant is an anionic aryl phenol alkoxylate.

13. An imaging element of claim 11 wherein the dispersant has the formula:

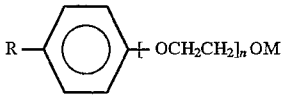

n = 10–25
R = aryl and M = $PO_3^{2-}2X+$
X = $Na^+$, $K^+$ or $NH_4^+$

14. An imaging element according to claim 11 wherein said one radiation-sensitive emulsion layer contains abrasive particles.

15. An imaging element according to claim 1 wherein a processing solution permeable overcoat overlies said one emulsion layer.

16. An imaging element according to claim 15 wherein the processing solution permeable overcoat contains a lubricant.

17. An imaging element according to claim 16 wherein the lubricant is carnauba wax.

* * * * *